US006692323B1

(12) United States Patent
Moradi et al.

(10) Patent No.: US 6,692,323 B1
(45) Date of Patent: Feb. 17, 2004

(54) STRUCTURE AND METHOD TO ENHANCE FIELD EMISSION IN FIELD EMITTER DEVICE

(75) Inventors: Behnam Moradi, Boise, ID (US); Tian Zhang, Boise, ID (US); John Lee, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/483,409

(22) Filed: Jan. 14, 2000

(51) Int. Cl.[7] ..... H01J 9/02
(52) U.S. Cl. ..... 445/24; 445/50; 445/58
(58) Field of Search ..... 445/24, 50, 58

(56) References Cited

U.S. PATENT DOCUMENTS

| | | | | | |
|---|---|---|---|---|---|
| 3,665,241 | A | | 5/1972 | Spindt et al. | 313/351 |
| 3,755,704 | A | | 8/1973 | Spindt et al. | 313/309 |
| 3,812,559 | A | | 5/1974 | Spindt et al. | 29/25.18 |
| 5,186,670 | A | * | 2/1993 | Doan et al. | 445/24 |
| 5,229,331 | A | | 7/1993 | Doan et al. | 437/228 |
| 5,229,682 | A | | 7/1993 | Komatsu | 313/309 |
| 5,259,799 | A | | 11/1993 | Doan et al. | 445/24 |
| 5,358,908 | A | | 10/1994 | Reinberg et al. | 437/228 |
| 5,372,973 | A | | 12/1994 | Doan et al. | 437/228 |
| 5,401,676 | A | | 3/1995 | Lee | 437/200 |
| 5,458,518 | A | | 10/1995 | Lee | 445/24 |
| 5,564,958 | A | * | 10/1996 | Itoh et al. | 445/6 |
| 5,597,444 | A | | 1/1997 | Gilton | 156/643.1 |
| 5,627,427 | A | | 5/1997 | Das et al. | 313/308 |
| 5,653,619 | A | | 8/1997 | Cloud et al. | 445/24 |
| 5,666,020 | A | * | 9/1997 | Takemura | 313/306 |
| 5,769,679 | A | * | 6/1998 | Park et al. | 313/309 |
| 5,844,250 | A | * | 12/1998 | Itoh et al. | 257/10 |
| 5,853,492 | A | | 12/1998 | Cathey et al. | 134/3 |
| 5,857,885 | A | | 1/1999 | Laou et al. | 445/24 |
| 5,898,258 | A | | 4/1999 | Sakai et al. | 313/309 |
| 5,910,791 | A | | 6/1999 | Zimlich et al. | 345/74 |
| 5,956,611 | A | * | 9/1999 | Cathey, Jr. et al. | 438/630 |
| 6,008,063 | A | | 12/1999 | Derraa | 438/20 |
| 6,028,322 | A | | 2/2000 | Moradi | 257/10 |
| 6,080,032 | A | | 6/2000 | Alwan | 445/50 |
| 6,194,826 | B1 | * | 2/2001 | Satou et al. | 313/485 |
| 6,232,705 | B1 | * | 5/2001 | Forbes et al. | 313/309 |
| 6,323,587 | B1 | * | 11/2001 | Zhang et al. | 313/309 |

OTHER PUBLICATIONS

Hug, S.E., et al., "Fabrication of Gated Polycrystalline Silicon Field Emitters", *9th International Vacuum Microelectrics Conference*, St. Petersburg, pp. 367–370, (1996).
Kim, H., et al., "Metal FEA's on Double Layer Structure of Polycrystalline Silicon", *9th International Vacuum Microelectronics Conference*, St. Petersburg, pp. 423–426, (1996).
Kim, I.H., et al., "Fabrication of metal field emitter arrays on polycrystalline silicon", *J. Vac. Sci. Technol. B 15* (2), pp. 468–471, (1997).

(List continued on next page.)

*Primary Examiner*—Kenneth J. Ramsey
(74) *Attorney, Agent, or Firm*—Schwegman, Lundberg, Woessner & Kluth, P.A.

(57) ABSTRACT

A structure and method are provided to inhibit degradation to the electron beam of a field emitter device by coating the field emitter tip with a substance or a compound. The substance or compound acts in the presence of outgassing to inhibit such degradation. In one embodiment, the substance or compound coating the field emitter tip is stable in the presence of outgassing. In another embodiment, the substance or compound decomposes at least one matter in the outgassing. In yet another embodiment, the substance or compound neutralizes at least one matter in the outgassing. In a further embodiment, the substance or compound brings about a catalysis in the presence of outgassing.

43 Claims, 9 Drawing Sheets

OTHER PUBLICATIONS

Lazarouk, S., et al., "Electrical characterization of visible emitting electroluminescent Schottky diodes based on n–type porous silicon and on highly doped n–typed porous polysilicon", *Journal of Non–Crystalline Solids*, pp. 973–976, (1996).

Lee, J.H., et al., "A New Fabrication Method of Silicon Field Emitter Array with Local Oxidation of Polysilicon and Chemical–Mechanical–Polishing", *9th International Vacuum Microelectronics Conference*, St. Petersburg, pp. 415–418, (1996).

Pullen, S.E., et al., "Enhanced Field Emission from Polysilicon Emitters Using Porous Silicon", *9th International Vacuum Microelectronics Conference*, St. Petersburg, pp. 211–214, (1996).

Uh, H.S., et al., "Enhanced Electron Emission and Its Stability from Gated Mo–polycide Field Emitters", *IEEE*, pp. 713–716, (1997).

Uh, H.S., et al., "Fabrication and Characterization of Gated n Polycrystalline Silicon Field Emitter Arrays", *9th International Vacuum Microelectronics Conference*, St. Petersburg, pp. 419–422, (1996).

Uh, H.S., et al., "Process design and emission properties of gated n polycrystalline silicon field emitter arrays for flat–panel display applications", *J. Vac. Sci. Technol. B 15* (*2*), pp. 472–476, (1997).

Anderson, R.C., et al., "Porous Polycrystalline Silicon: A New Material for MEMS", *IEEE*, pp. 10–18, (1994).

Boswell, E.C., et al., "Polycrystalline Silicon Field Emitters", *8th International Vacuum Microelectronics Conference Technical Digest*, pp. 181–185, (1996).

Boswell, E.C., et al., "Polycrystalline Silicon Field Emitters", *J. Vac. Sci. Technol. B 14* (*3*), pp. 1910–1913, (1996).

Huang, W.N., et al., "Photoluminescence in porous sputtered polysilicon films formed by chemical etching", *Semicond. Sci. Technol., 12*, pp. 228–233, (1997).

Huang, W.N., et al., "Properties of chemically etched porous polycrystalline silicon deposited by r.f. sputtering", *IEEE Hong Kong Electron Devices Meeting*, pp. 21–24, (1996).

Hug, S.E., et al., "Comparative study of gated single crystal silicon and polysilicon field emitters", *J. Vac. Sci. Technol. B 15* (*6*), pp. 2855–2858, (1997).

* cited by examiner

STRUCTURE AND METHOD TO ENHANCE FIELD EMISSION IN FIELD EMITTER DEVICE

FIELD

The present invention relates generally to semiconductor integrated circuits. More particularly, it pertains to structures and methods to enhance field emission in a field emitter device in the presence of outgassing.

BACKGROUND

Recent years have seen an increased interest in field emitter displays. This is attributable to the fact that such displays can fulfill the goal of consumer affordable hang-on-the-wall flat panel television displays with diagonals in the range of 20 to 60 inches. Certain field emitter displays, or flat panel displays, operate on the same physical principle as fluorescent lamps. A gas discharge generates ultraviolet light that excites a phosphor layer that fluoresces visible light. Other field emitter displays operate on the same physical principles as cathode ray tube (CRT) based displays. Excited electrons are guided to a phosphor target to create an image. The phosphor then emits photons in the visible spectrum. Both methods of operation for field emitter displays rely on an array of field emitter tips.

Although field emitter displays promise to provide better color and image resolution, one of their problems is that video images on these displays tend to take on undesired viewing characteristics over a short period of time. One of these characteristics is that the video image becomes grainy on the display. Another characteristic is the decimation of the video image on the display. In an investigation into the source of the undesired viewing characteristics, it was discovered that degradation to the field emitter display is a cause of the problem. Such reliability issues raise questions about the commercial success of the displays in the marketplace.

Thus, what are needed are structures and methods to enhance the field emitter displays so that such degradation over time may be addressed.

SUMMARY

The above mentioned problems with field emitter displays and other problems are addressed by the present invention and will be understood by reading and studying the following specification. Structures and methods are described which accord these benefits.

In particular, an illustrative embodiment of the present invention includes a field emitter display device, comprising at least one emitter having a coating that releases electrons at a predetermined energy level, the coating acts in the presence of outgassing to inhibit degradation of at least one emitter. The illustrative embodiment also discloses that the coating decomposes at least one matter in the outgassing to a non-reactive state to inhibit degradation of at least one emitter. The illustrative embodiment also discloses that the outgassing includes organic matters. The illustrative embodiment also discloses that the coating is titanium nitride, nitride based metals, platinum, or platinum silicide. The illustrative embodiment also discloses that the coating is stable in the presence of outgassing to inhibit degradation of at least one emitter. The illustrative embodiment also discloses that the coating neutralizes at least one matter in the outgassing to inhibit degradation of at least one emitter, or brings about heterogeneous catalysis in the presence of outgassing to inhibit degradation of at least one emitter.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION

Figure 1A:
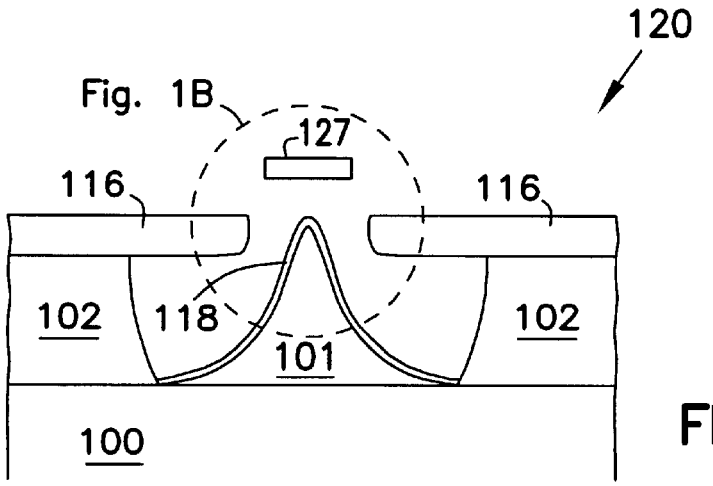
FIG. 1 is a close-up illustration of an emitter tip according to an embodiment of the present invention.

In the following detailed description of the invention, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention.

The terms wafer and substrate used in the following description include any structure having an exposed surface with which to form the integrated circuit (IC) structure of the invention. The term substrate is understood to include semiconductor wafers. The term substrate is also used to refer to semiconductor structures, such as glass during processing, and may include other layers, such as dielectric that have been fabricated thereupon. Both wafer and substrate include doped and undoped semiconductors, epitaxial semiconductor layers supported by a base semiconductor or insulator, as well as other semiconductor structures well known to one skilled in the art. The term conductor is understood to include semiconductors, and the term insulator is defined to include any material that is less electrically conductive than the materials referred to as conductors. The following detailed description is, therefore, not to be taken in a limiting sense, and the scope of the present invention is defined only by the appended claims, along with the full scope of equivalents to which such claims are entitled.

The term horizontal as used in this application is defined as a plane parallel to the conventional plane or surface of a wafer or substrate, regardless of the orientation of the wafer or substrate. The term vertical refers to a direction perpendicular to the horizontal as defined above. Prepositions, such as on, side (as in sidewall), higher, lower, over, and under are defined with respect to the conventional plane or surface being on the top surface of the wafer or substrate, regardless of the orientation of the wafer or substrate.

In the process of identifying the source of undesired viewing characteristics, it was discovered that the beam of emitted electrons is smaller in those field emitter displays suffering from image quality degradation. These smaller beams of emitted electrons disrupt the visual continuity of the eyes. Thus, when the video image is presented in these displays, the viewer sees such disruption as spots or grains in the picture. Because the emitted electrons are the product of the array of tips in the field emitter display, the tip is discussed in detail below.

Figure 1B:
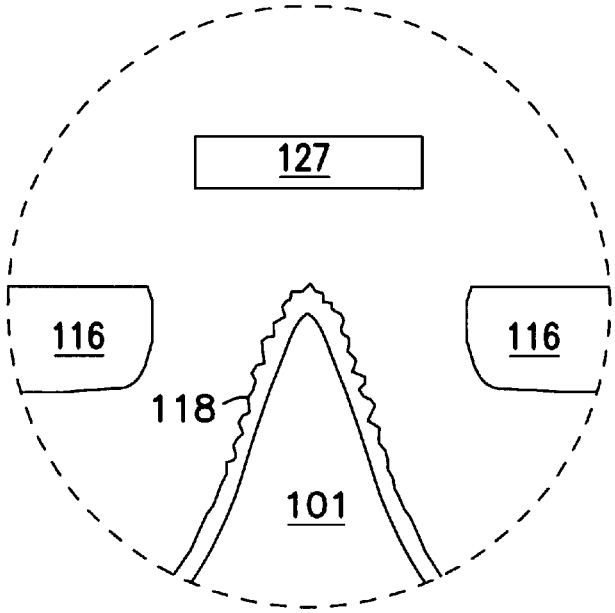

FIG. 1 shows an embodiment of an emitter tip according to an embodiment of the present invention. A field emitter device 120 includes a substrate 100, a cathode tip 101 formed on the substrate 100, gate insulator layer 102, gate lines 116, and a phosphorescent anode 127 in opposing position with respect to the cathode tip 101. The construction of those elements of the field emitter device 120 will be explained below.

The cathode tip 101 emits electrons in response to the presence of an electric field. The phosphorescent anode 127 releases photons when the emitted electrons strike the surface of the phosphorescent anode 127. An array of cathode tips 101 and phosphorescent anodes 127 forms the field emitter display. Video images are shown on the display as a result of the input of visual signals being modulated by the array of cathode tips 101 and phosphorescent anodes 127.

The cathode 101 includes a coating 118. The surface of the cathode tip 101 is filled with asperities after an etching process in the construction the field emitter device. These asperities cause the surface of the cathode tip 101 to be irregular as it populates the surface with protrusions at random and in different orientations. The asperities microscopically appear like tall mountains and deep valleys on the surface of the cathode tip 101. The atomic bond that holds electrons close to the nucleus of the atom is weakest at these mountains. Additionally, the microscopic mountains are sites of intensely strong electric field. This helps to pull the electrons away from the cathode tip 101 and hurl them toward the phosphorescent anode 127. Therefore, these asperities contribute in larger beams of emitted electrons by easing the release of electrons.

Outgassed substances and compounds exist in the environment near the vicinity of the cathode tip 101. The anode 127, the site that releases photons upon contact by the emitted electrons from the cathode tip 101, is one source of the outgassing. The outgassing may contain carbon-based compounds, oxygen, hydrogen, water, argon, nitrogen, organic matters, and others. In the absence of coating 118, these outgassed substances and compounds act against the cathode tip 101 to wear down the mountains and fill up the valleys of the asperities. Once the physical structure of the emitter tip is changed, the size of the emitted electron beam is correspondingly reduced.

Yet another way of understanding the problem is to look at a measurement called the work function. The work function is a quantity of energy that must be supplied to move the electron from the surface of the cathode tip 101. Electrons that are more tightly bound within the metal of the cathode tip 101 require more energy to move. Different metals have different work functions. In the presence of outgassing, the cathode tip 101 without the coating 118 reacts to the outgassed materials to increase the bond that binds the electron in the metal of the emitter tip. Therefore, the work function of the cathode tip 101 without the coating 118 is increased in the presence of outgassing. As a result, the size of the emitted electron beam is also reduced.

The coating 118 helps the cathode tip 101 to be stable in the presence of the outgassing. It does so in several ways: In one embodiment, the coating decomposes organic substances and compounds to render them non-reactive with respect to the cathode tip 101. In another embodiment, the coating neutralizes the organic substances and compounds in the presence of outgassing. In a further embodiment, the coating brings about a catalysis, such as heterogeneous catalysis, in the presence of the outgassing.

In addition to the aforementioned embodiments that help the cathode tip 101 to remain stable in the presence of outgassing, stable is understood to include resistance to forces that disturb or alter the chemical makeup or physical state of the cathode tip 101.

In one embodiment, the coating 118 contains a metal compound that is less reactive to outgassed substances than cathode tip 101. In another, the coating 118 on the cathode tip 101 can include one or more metal compounds such as titanium nitride, titanium silicide, nitride-based metals, platinum, or platinum silicide. In a further embodiment, the coating 118 is platinum or platinum silicide.

The coating 118 may cover the cathode tip 101 in one embodiment, or in another embodiment, it may be embedded in the surface of the cathode tip 101.

Figure 2:
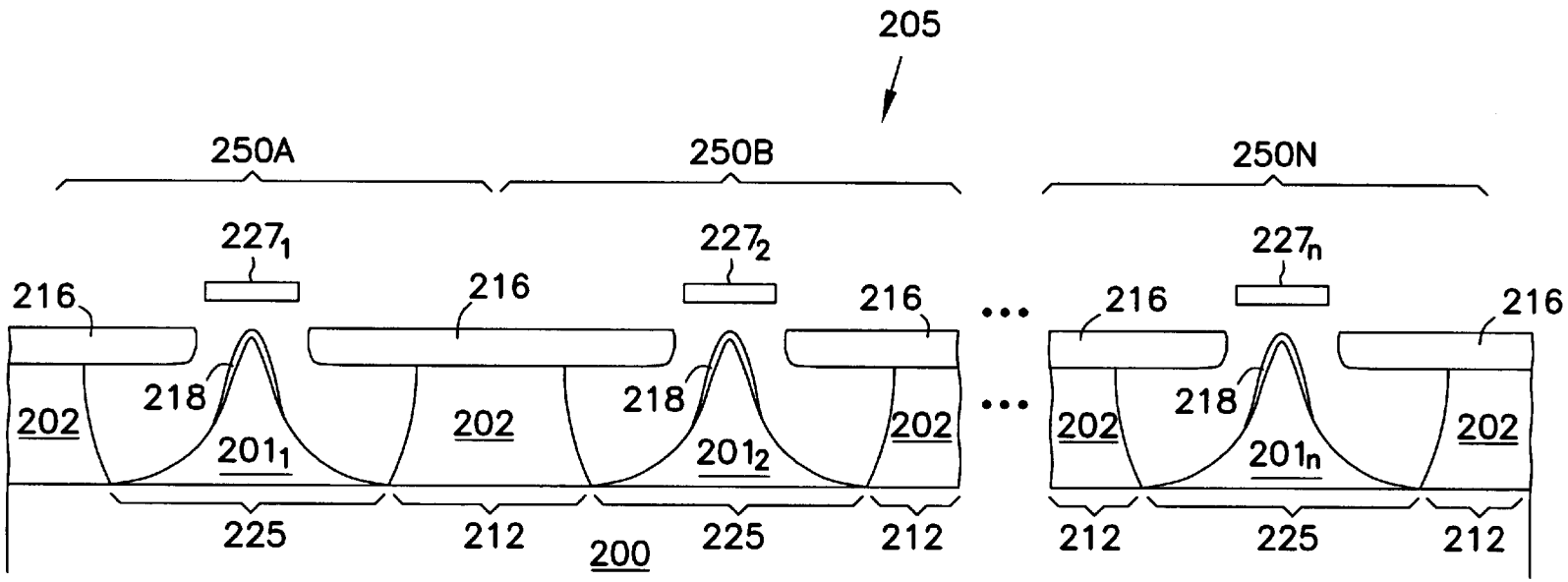
FIG. 2 is a planar view of a portion of an array of field emitters according to one embodiment of the present invention.

FIG. 2 is a planar view of an embodiment of a portion of an array of field emitter devices including 250A, 250B, 250C, . . . , 250N, and constructed according to an embodiment of the present invention. The field emitter array 250 includes a number of cathodes, $\mathbf{201}_1$, $\mathbf{201}_2$, $\mathbf{201}_3$, . . . , $\mathbf{201}_n$ formed in rows along a substrate 200. A gate insulator 202 is formed along the substrate 200 and surrounds the cathodes. A number of gate lines are on the gate insulator. A number of anodes including $\mathbf{227}_1$, $\mathbf{227}_2$, $\mathbf{227}_3$, . . . , $\mathbf{227}_n$ are formed in columns orthogonal to and opposing the rows of cathodes. In one embodiment, the anodes include multiple phosphors. In another embodiment, the anodes are coated with a phosphorescent or luminescent substances or compounds. Additionally, the intersection of the rows and columns form pixels.

Each field emitter device in the array, 250A, 250B, . . . , 250N, is constructed in a similar manner. Thus, only one field emitter device 250N is described herein in detail. All of the field emitter devices are formed along the surface of a substrate 200. In one embodiment, the substrate includes a doped silicon substrate 200. In an alternate embodiment, the substrate is a glass substrate 200, including silicon dioxide ($SiO_2$). Field emitter device 250N includes a cathode 201 formed in a cathode region 225 of the substrate 200. The cathode 201 includes a cone 201. The material of the cone 201 is understood to include polysilicon, amorphous silicon, or microcrystalline silicon. In one embodiment, the cone 201 has a silicon film. In one exemplary embodiment, the cone 201 includes a coating 218.

This coating, in one embodiment, interacts in the presence of the outgassing which is present in the environment near the vicinity of the cone 201. In another embodiment, this coating reacts to the outgassing. In all embodiments, the coating acts in the presence of the outgassing to inhibit degradation of the cone 201.

A gate insulator 202 is formed in an insulator region 212 of the substrate 200. The gate insulator 202 is a porous oxide layer 202. And the cone 201 and the porous oxide layer 202 have been formed, in one embodiment, from a single layer of polysilicon. A gate 216 is formed on the gate insulator 202.

An anode 227 opposes the cathode 201. In one embodiment, the anode is covered with light emitting substances or compounds that are luminescent or phosphorescent.

Figure 3A:
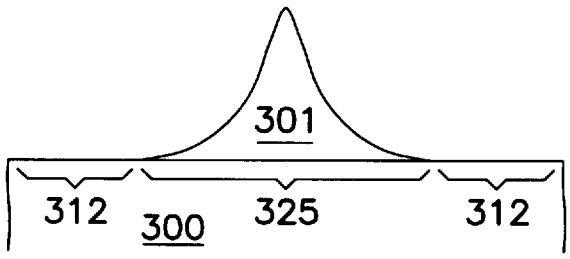
FIGS. 3A–3G are planar views of a field emitter device during various stages of fabrication according to one embodiment of the present invention.

FIGS. 3A–3G show a process of fabrication for a field emitter device according to an embodiment of the present invention. FIG. 3A shows the structure focusing on the cathode tip, after tip sharpening, following the first stages of processing. These stages are taught, for example, in FIGS. 1–5 in co-pending application Ser. No. 09/261,477, entitled Structure and Method for Field Emitter Tips, filed Feb. 26, 1999.

Figure 3B:
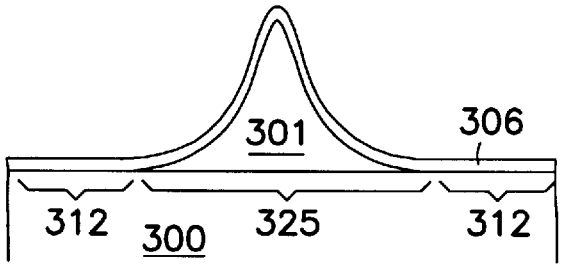

FIG. 3B shows a deposit of a thin layer of substance 306 over the entire area of substrate 300, including the cathode tip 301. In one embodiment, the substance is platinum. That layer of substance 306 may be deposited using any suitable technique such as, for example, chemical vapor deposition (CVD). In another embodiment, the substance 306 may be deposited using a sputtering process. That substance acts in the presence of outgassing to inhibit degradation to the cathode tip 301. The temperature range in of a process for depositing substance 306 is about 300 to 400 degrees Celsius.

Figure 3C:
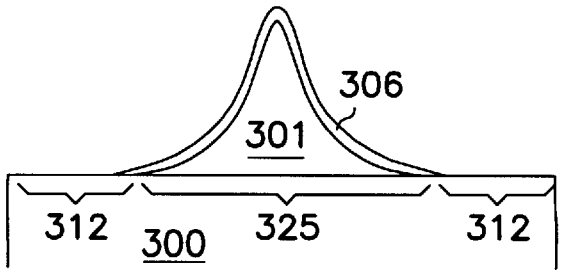

FIG. 3C shows the structure after the next sequence of fabrication stages. In one embodiment, a photoresist is applied and exposed to define a mask over the cathode region 325 of the substrate 300. An etching process is then applied to the structure. The etching process removes the substance 306 (e.g., platinum) from all areas of the substrate 300, except the masked cathode region 325. The structure now appears as in FIG. 3C.

Figure 3D:
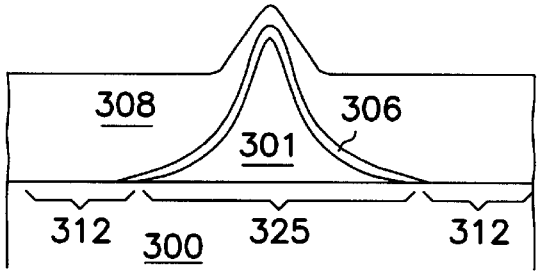

FIG. 3D shows the structure following the next sequence of processing. The insulator 308 may be referred to as a gate insulator or grid dielectric. In FIG. 3D, insulator 308 is formed over the cathode tip 301 and the substrate 300. The regions of the insulator 308 that surround the cathode tip 301 constitute an insulator region 312 for the field emitter device.

Figure 3E:
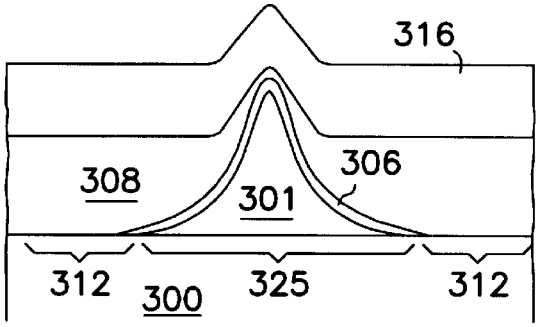

FIG. 3E shows the structure following the next stages of processing. A gate, or gate layer 316 is formed on the insulator layer 308. The gate layer 316 includes any conductive layer material and can be formed using any suitable technique. One exemplary technique includes chemical vapor deposition (CVD).

Figure 3F:
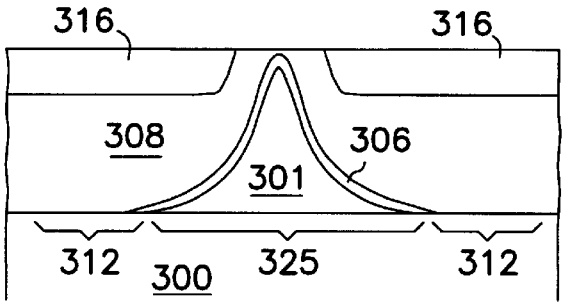

FIG. 3F shows the structure following the next stages of processing. Following deposition, the gate layer 316 undergoes a removal stage and may include using chemical mechanical planarization (CMP). The gate layer 316 is removed. In one embodiment, the gate layer 316 is removed until a portion of the insulator layer 308, covering the cathode tip 301, is revealed.

Figure 3G:
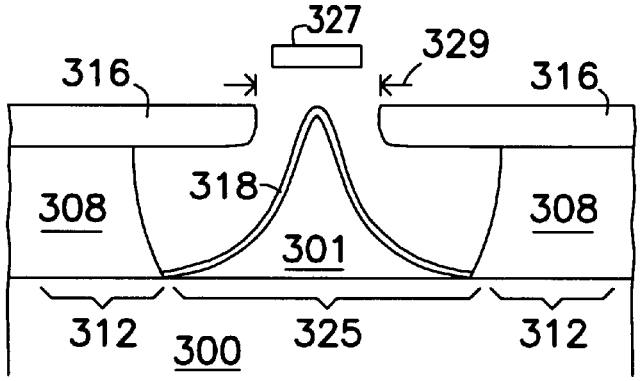

FIG. 3G shows the structure after the next sequence of processing. Here a portion of the insulator layer 308 is removed from surrounding the cathode tip 301. The portion of the insulator layer 308 is removed using any suitable technique as will be understood by one of ordinary skill in the field of semiconductor processing and field emission device fabrication. The formation of the anode 327 is further formed opposing the cathode tip 301 in order to complete the field emission device. The formation of the anode, and completion of the field emission device structure, can be achieved in numerous ways as will be understood by those of ordinary skill in the art of semiconductor and field emission device fabrication.

Figure 4A:
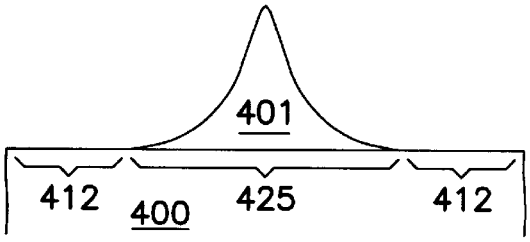
FIGS. 4A–4G are planar views of a field emitter device during various stages of fabrication according to another embodiment of the present invention.

FIGS. 4A–4G show fabrication of a field emitter device according to an embodiment of the present invention. FIG. 4A shows the structure focusing on the cathode tip, after tip sharpening, following the first stages of processing. These stages are taught, for example, in FIGS. 1–5 in application Ser. No. 09/261,477, entitled Structure and Method for Field Emitter Tips, filed Feb. 26, 1999.

Figure 4B:
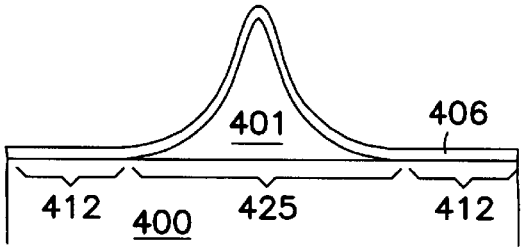

FIG. 4B shows a deposit of a thin layer of substance 406 over the entire area of substrate 400, including the cathode tip 401. In one embodiment, the substance is platinum. That layer of substance 406 may be deposited using any suitable technique such as, for example, chemical vapor deposition (CVD). In another embodiment, the substance 406 may be deposited using a sputtering process. The substance 406, in a compound, acts in the presence of outgassing to inhibit degradation to the cathode tip 401.

Figure 4C:
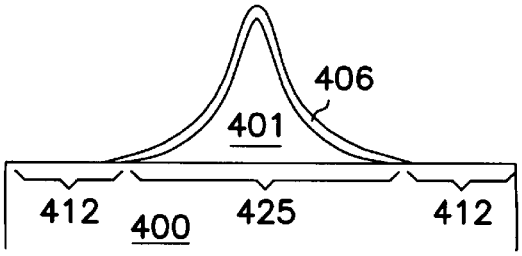

FIG. 4C shows the structure after the next sequence of fabrication stages. The structure is put through an annealing process. In one embodiment the temperature range for the annealing is about 700 to 900 degrees Celsius. In another embodiment the temperature range for the annealing is about 800 to 900 degrees Celsius. The cathode tip 401 reacts with the substance 406 to form a compound on the cathode tip 401. In the embodiment that uses platinum for the substance, the resultant compound 418 contains platinum silicide when the cathode tip 401 contains silicon. The compound 418 acts in the presence of outgassing to inhibit degradation to the cathode tip 401.

An etching process is then applied to the structure. The etching process removes the excess substance 406 from all areas of the substrate 400, except where the substance 406 has reacted with the cathode tip 401 to form the compound 418. The etching process uses a mixture to remove the excess substance 406. In one embodiment, the mixture contains two strong acids and one weak acid; strong acids are understood to be 100 percent ionized in aqueous solution whereas weak acids are understood to ionize only partially; the strong acids include HCL and $HNO_3$ and the weak acid includes HF. In another embodiment, the mixture contains two hydrohalic acids and one oxyacid. In another embodiment, the mixture contains two binary acids and one ternary acid. In yet another embodiment, the mixture contains one nonoxidizing acid, one binary acid, and one oxyacid. In all embodiments, the mixture contains substances capable of donating a proton.

In another embodiment, the mixture is aqua regia. Aqua regia is also known as a nitrohydrochloric acid, chloronitrous acid, or chlorazotic acid. In a further embodiment, aqua regia is a mixture of nitric and hydrochloric acids, usually 1 part of nitric acid to 3 or 4 parts of hydrochloric acid.

Figure 4D:
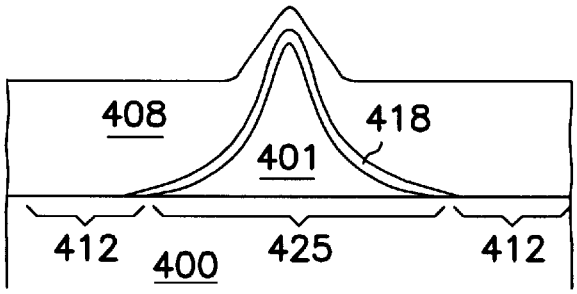

FIG. 4D shows the structure following the next sequence of processing. The insulator 408 is also known as a gate insulator, or grid dielectric. In FIG. 4D, the insulator 408 is formed over the cathode tip 401 and the substrate 400. The regions of the insulator 408 that surround the cathode tip 401 constitute an insulator region 412 for the field emitter device.

Figure 4E:
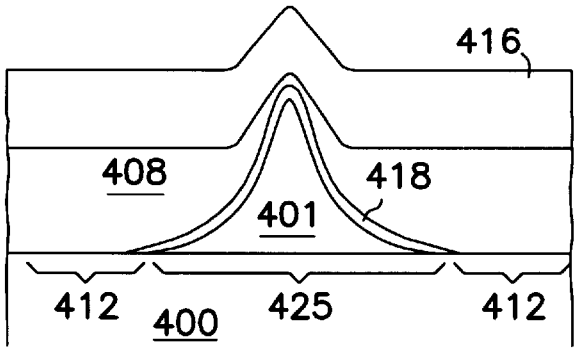

FIG. 4E shows the structure following the next stages of processing. A gate, or gate layer 416 is formed on the insulator layer 408. The gate layer 416 includes any conductive layer material and can be formed using any suitable technique. One exemplary technique includes chemical vapor deposition (CVD).

Figure 4F:
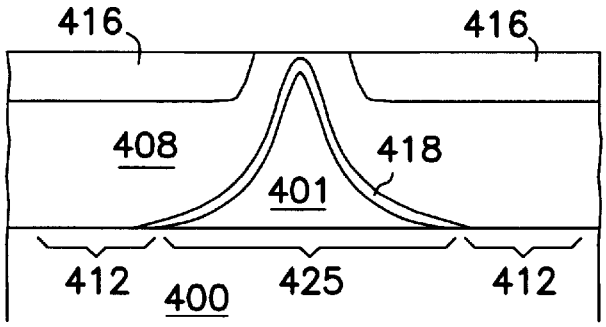

FIG. 4F shows the structure following the next stages of processing. Following deposition, the gate layer 416 undergoes a removal stage using chemical mechanical planarization (CMP). The gate layer 416 is removed using CMP until a portion of the insulator layer 408, covering the cathode tip 401, is revealed.

Figure 4G:
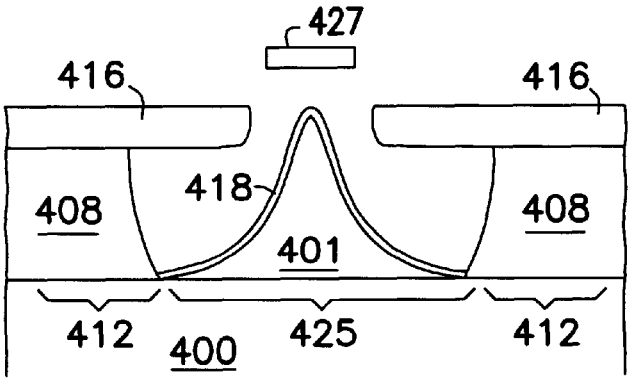

FIG. 4G shows the structure after the next sequence of processing. Here a portion of the insulator layer 408 is removed from surrounding the cathode tip 401. The portion of the insulator layer 408 is removed using any suitable technique as will be understood by one of ordinary skill in the field of semiconductor processing and field emission device fabrication. The formation of the anode 427 is further formed opposing the cathode tip 401 in order to complete the field emission device. The formation of the anode, and the completion of the field emission device structure, can be achieved in numerous ways as will be understood by those of ordinary skill in the art of semiconductor and field emission device fabrication.

Figure 5:
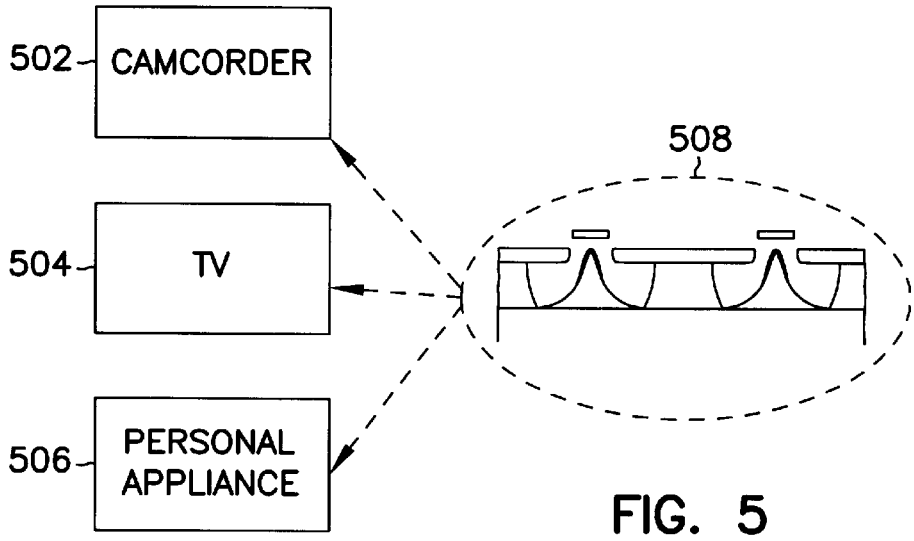
FIG. 5 is a sample of commercial products using a video display according to one embodiment of the present invention.

FIG. 5 shows exemplary video display products using an array of field emitter devices 508 in accordance with an embodiment of the present invention. The array of field emitter devices 508 are described and presented above in connection with FIGS. 1–4G. In one embodiment, the video display product is a camcorder 502; the camcorder 502 includes a camcorder viewfinder. In another embodiment, the video display product is a flat-screen television 504. In a further embodiment, the video display product is a personal appliance 506. In all embodiments, the video display product includes a display screen for showing a video image.

Figure 6:
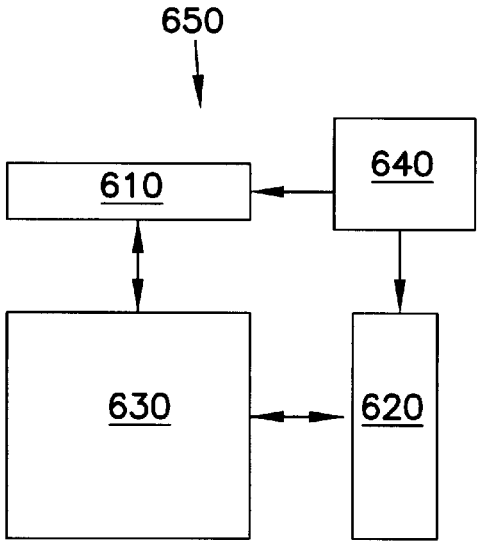
FIG. 6 is a block diagram which illustrates a flat panel display system according to one embodiment of the present invention.

FIG. 6 is a block diagram that illustrates an embodiment of a flat panel display system 650 according to an embodiment of the present invention. A flat panel display includes a field emitter array formed on a glass substrate. The field emitter array includes the field emitter array described and presented above in connection with FIGS. 1–4. A row decoder 620 and a column decoder 610 each couple to the field emitter array 630 in order to selectively access the array. Further, a processor 640 is included which is adapted to receiving input signals and providing the input signals to address the row and column decoders 620 and 610.

Conclusion

Thus, a structure and method have been described to enhance field emission of the field emitter device in the presence of outgassing. The novel invention achieves this without having to seal the anode, for example, using aluminum to prevent one source of outgassing. Thus, the coating on the field emitter cathode tip may maintain the beam size over extended operation at lower power dissipation. Field emitter devices in accordance with the invention may maintain beam definition without the need to increase the gap between the anode and the cathode.

Although the specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. Accordingly, the scope of the invention should only be determined with reference to the appended claims, along with the full scope of equivalents to which such claims are entitled.

What is claimed is:

1. A method for maintaining field emissions over time in a field emitter device, comprising:

forming at least one tip behaving as cathodes in the field emitter device, the at least one tip emitting electrons at a predetermined energy level;

forming at least one phosphorescent target behaving as anodes in the field emitter device, the at least one phosphorescent target receptive to the emitted electrons; and coating the at least one tip with a substance, the substance acts in the presence of outgassing to inhibit degradation in the field emitter device and to decompose the outgassing to a non-reactive state, wherein the substance includes titanium nitride.

2. The method of claim 1, wherein the method proceeds in the order presented.

3. The method of claim 1, wherein the outgassing includes organic matters.

4. The method of claim 1, wherein the substance brings about heterogeneous catalysis in the presence of outgassing.

5. The method of claim 1, wherein the substance is further includes platinum.

6. A method of forming a field emission device, comprising:

forming an emitter tip on a substrate;

forming a layer of a substance on at least a portion of the emitter tip, the substance acts in the presence of outgassing to inhibit degradation of the emitter tip and to decompose the outgassing to a non-reactive state, wherein the substance includes titanium nitride; and forming an anode opposite the emitter tip.

7. The method of claim 6, wherein forming a layer of a substance further comprises etching to remove the substance from all regions except the at least a portion of the emitter tip.

8. The method of claim 6, further comprising:

forming a gate insulator layer on the emitter tip and the substrate;

depositing a conductive matter on the gate insulator layer; and using a chemical mechanical planarization (CMP) process on the conductive matter to expose a portion of the gate insulator layer surrounding the emitter tip.

9. The method of claim 8, wherein forming a layer of a substance on the emitter tip and the substrate includes forming an layer at a temperature greater than about 300 degrees Celsius.

10. The method of claim 8, wherein forming a layer of a substance on the emitter tip and the substrate includes forming an layer at a temperature lesser than about 400 degrees Celsius.

11. The method of claim 8, wherein forming a layer of a substance on the emitter tip and the substrate includes forming an layer at a temperature in the range of about 300 to 400 degrees Celsius.

12. A method of forming a field emission device, comprising:

forming an emitter tip on a substrate;

sputtering a layer of a substance on at least a portion of the emitter tip, the substance acts in the presence of outgassing to inhibit degradation of the emitter tip and to decompose the outgassing to a non-reactive state, wherein the substance is titanium nitride, forming a gate insulator layer on the emitter tip and the substrate;

depositing a conductive matter on the gate insulator layer;

using a chemical mechanical planarization (CMP) process on the conductive matter to expose a portion of the gate insulator layer surrounding the emitter tip; and forming an anode opposite the emitter tip.

13. A method of forming a field emission device, comprising:

forming an emitter tip on a substrate;

forming a layer of titanium nitride on at least a portion of the emitter tip by a chemical vapor deposition (CVD) process, the substance acts in the presence of outgassing to inhibit degradation of the emitter tip and to decompose the outgassing to a non-reactive state;

forming a gate insulator layer on the emitter tip and the substrate;

depositing a conductive matter on the gate insulator layer;

using a chemical mechanical planarization (CMP) process on the conductive matter to expose a portion of the gate insulator layer surrounding the emitter tip; and forming an anode opposite the emitter tip.

14. A method of forming a field emission device, comprising:

forming an emitter tip on a substrate;

forming a layer of titanium nitride on at least a portion of the emitter tip, the substance decomposes at least one matter in the presence of outgassing to inhibit degradation of the emitter tip and to decompose the outgassing to a non-reactive state;

forming a gate insulator layer on the emitter tip and the substrate;

depositing a conductive matter on the gate insulator layer using a chemical mechanical planarization (CMP) process on the conductive matter to expose a portion of the gate insulator layer surrounding the emitter tip; and forming an anode opposite the emitter tip.

15. A method of forming a field mission device, comprising:

forming an emitter tip on a substrate;

forming a layer of titanium nitride on at least a portion of the emitter tip, the substance brings about heterogeneous catalysis in the presence of outgassing to inhibit degradation of the emitter tip and to decompose the outgassing to a non-reactive state;

forming a gate insulator layer on the emitter tip and the substrate;

depositing a conductive matter on the gate insulator layer;

using a chemical mechanical planarization (CMP) process on the conductive matter to expose a portion of the gate insulator layer surrounding the emitter tip; and forming an anode opposite the emitter tip.

16. A method of forming a field emission device, comprising:

forming an emitter tip on a substrate;

forming a layer of a substance on at least a portion of the emitter tip, the substance is stable in the presence of outgassing to inhibit degradation of the emitter tip and to decompose the outgassing to a non-reactive state, wherein the substance includes titanium nitride;

forming a gate insulator layer on the emitter tip and the substrate;

depositing a conductive matter on the gate insulator layer, using a chemical mechanical planarization (CMP) process on the conductive matter to expose a portion of the gate insulator layer surrounding the emitter tip; and forming an anode opposite the emitter tip.

17. The method of claim 16, wherein the method proceeds in the order presented.

18. A method of forming a field emission device, comprising:

forming a cathode emitter tip on a substrate;

forming a layer of a substance, including titanium nitride, on the emitter tip and the substrate, the substance in a compound acts in the presence of outgassing to inhibit degradation to the cathode emitter tip and to decompose the outgassing to a non-reactive state;

annealing to form the compound on the cathode emitter tip;

etching to remove the excess substance; and forming an anode opposite the cathode emitter tip.

19. The method of claim 18, further comprising:

forming a gate insulator layer on the cathode emitter tip and the substrate;

depositing a conductive matter on the gate insulator layer; and using a chemical mechanical planarization (CMP) process on the conductive matter in order to expose a portion of the gate insulator layer surrounding the emitter tip.

20. The method of claim 19, wherein etching further comprises a mixture of substances capable of donating a proton.

21. The method of claim 20, wherein forming a layer of the substance on the cathode emitter tip and the substrate is by a sputtering process.

22. The method of claim 20, wherein forming a layer of the substance on the cathode emitter tip and the substrate is by a chemical vapor deposition (CVD) process.

23. The method of claim 20, wherein the compound neutralizes the outgassing.

24. The method of claim 20, wherein the compound is stable in the presence of outgassing.

25. The method of claim 20, wherein the compound brings about heterogeneous catalysis in the presence of outgassing.

26. The method of claim 20, wherein the compound includes platinum silicide.

27. The method of claim 20, wherein annealing comprises temperature greater than about 700 degrees Celsius.

28. The method of claim 20, wherein annealing comprises temperature less than about 900 degrees Celsius.

29. The method of claim 20, wherein annealing comprises temperature greater than about 800 degrees Celsius.

30. The method of claim 20, wherein the method proceeds in the order presented.

31. The method of claim 20, wherein annealing comprises temperature in the range of about 700 to 900 degrees Celsius.

32. The method of claim 34, wherein annealing comprises temperature in the range of about 800 to 900 degrees Celsius.

33. The method of claim 20, wherein the mixture comprises at least two strong acids and at least one weak acid.

34. The method of forming a field emission device of claim 33, wherein the at least two strong acids are HCI and $HNO_3$.

35. The method of forming a field emission device of claim 33, wherein the at least one weak acid is HF.

36. The method of claim 20, wherein the mixture comprises at least two hydrohalic acids and at least one oxyacid.

37. The method of claim 20, wherein the mixture comprises at least two binary acids and at least one ternary acid.

38. The method of claim 20, wherein the mixture comprises at least one nonoxidizing acid, at least one binary acid, and at least one oxyacid.

39. The method of claim 20, wherein the mixture is aqua regia.

40. A method for maintaining field emissions over time in a field emitter device, comprising:

forming at least one tip behaving as cathodes in the field emitter device, the at least one tip emitting electrons at a predetermined energy level;

forming a number of phosphorescent targets behaving as anodes in the field emitter device, the number of phosphorescent targets receptive to the emitted electrons; and coating the at least one tip with a substance, the substance includes titanium nitride and acts in the presence of outgassing to decompose at least one matter in the outgassing so as to inhibit degradation in the field emitter device.

41. A method for maintaining field emissions over time in a field emitter device, comprising:

forming at least one tip behaving as cathodes in the field emitter device, the at least one tip emitting electrons at a predetermined energy level;

forming a number of phosphorescent targets behaving as anodes in the field emitter device, the number of phosphorescent targets receptive to the emitted electrons; and coating the at least one tip with a compound including titanium and nitrogen, the compound acts in the presence of outgassing to bring about heterogenous catalysis of the outgassing so as to inhibit degradation in the field emitter device.

42. A method of forming a field emission device, comprising:

forming an emitter tip on a substrate;

forming a layer of a substance on at least a portion of the emitter tip, the substance includes titanium nitride and acts in the presence of outgassing to inhibit degradation of the emitter tip and to decompose the outgassing to a non-reactive state;

etching to remove the substance from all regions except the emitter tip;

forming a gate insulator layer on the emitter tip and the substrate;

depositing a conductive matter on the gate insulator layer;

using a chemical mechanical planarization (CMP) process on the conductive matter to expose a portion of the gate insulator layer surrounding the emitter tip; and forming an anode opposite the emitter tip.

43. A method of forming a field emission device, comprising:

forming a cathode emitter tip on a substrate;

forming a layer of titanium nitride on at least a portion of the emitter tip;

annealing the layer of the substance to form a compound on the cathode emitter tip, the compound acts in the presence of outgassing to inhibit degradation to the cathode emitter tip and to decompose the outgassing to a non-reactive state;

etching to remove the titanium nitride from all regions except where it has reacted to form the compound, forming a gate insulator layer on the cathode emitter tip and the substrate;

depositing a conductive matter on the gate insulator layer;

using a chemical mechanical planarization process on the conductive matter in order to expose a portion of the gate insulator layer surrounding the emitter tip; and forming an anode opposite the cathode emitter tip.

* * * * *

UNITED STATES PATENT AND TRADEMARK OFFICE

CERTIFICATE OF CORRECTION

PATENT NO. : 6,692,323 B1
DATED : February 17, 2004
INVENTOR(S) : Moradi et al.

It is certified that error appears in the above-identified patent and that said Letters Patent is hereby corrected as shown below:

Column 8,
Lines 52, 56 and 60, after “an” insert -- initial --.

Column 9,
Line 2, delete “,” and insert -- ; --, therefor.
Line 37, after “layer” insert -- ; --.

Column 10,
Line 1, delete “,” and insert -- ; --, therefor.
Line 58, delete “claim 34” and insert -- claim 31 --, therefor.

Column 12,
Line 30, delete “,” and insert -- ; --, therefor.

Signed and Sealed this

Twenty-fifth Day of October, 2005

JON W. DUDAS
*Director of the United States Patent and Trademark Office*